US005877589A

United States Patent [19]

Morgan et al.

[11] Patent Number: 5,877,589

[45] Date of Patent: Mar. 2, 1999

[54] GAS DISCHARGE DEVICES INCLUDING MATRIX MATERIALS WITH IONIZABLE GAS FILLED SEALED CAVITIES

[75] Inventors: Clifford O. Morgan, Burlington; Matthew J. Rutten, Milton; Erick G. Walton, South Burlington; Terrance M. Wright, Williston, all of Vt.

[73] Assignee: International Business Machines Corporation, Armonk, N.Y.

[21] Appl. No.: 819,346

[22] Filed: Mar. 18, 1997

[51] Int. Cl.[6] ..... H01J 17/49

[52] U.S. Cl. ..... 313/582; 313/584; 313/586; 313/234; 313/607; 445/24; 445/25

[58] Field of Search ..... 313/582, 584, 313/586, 607, 234; 445/9, 16, 21, 24, 25

[56] References Cited

U.S. PATENT DOCUMENTS

| | | | |
|---|---|---|---|
| 3,559,190 | 1/1971 | Bitzer et al. | 313/607 |
| 3,602,754 | 8/1971 | Pfsender et al. . | |
| 3,919,577 | 11/1975 | Hoehn et al. . | |
| 4,926,095 | 5/1990 | Shinoda et al. . | |
| 5,227,207 | 7/1993 | Toho . | |
| 5,469,021 | 11/1995 | Lepselter . | |
| 5,508,234 | 4/1996 | Dusablon, Sr. et al. . | |
| 5,545,948 | 8/1996 | Mii et al. . | |
| 5,559,403 | 9/1996 | Sakai et al. . | |

*Primary Examiner*—Nimeshkumar D. Patel
*Attorney, Agent, or Firm*—Whitham, Curtis & Whitham; Eugene I. Shkurko, Esq.

[57] ABSTRACT

A gas discharge illumination device is prepared by encapsulating ionizable gas within microporous or nanoscale sealed cavities created within a matrix material. Upon exposure of said matrix material to an electric field, the ionizable gas becomes ionized and emits light. By incorporating several different ionizable gases into one matrix material, a display with different colors of light can be produced. The gas discharge illumination device can be fabricated by a variety of techniques including selective cavity formation with overcoating taking place in an ionizable gas ambient, and bubbling ionizable gas through the matrix material while it is in viscous form. The gas discharge illumination device can be used to form either active or passive displays, as a sensor for detecting electric fields, and in other applications.

24 Claims, 1 Drawing Sheet

GAS DISCHARGE DEVICES INCLUDING MATRIX MATERIALS WITH IONIZABLE GAS FILLED SEALED CAVITIES

BACKGROUND OF THE INVENTION

1. Field of the Invention

The present invention generally relates to nanoscale illumination devices and, more particularly, to a simple and inexpensive nanoscale illumination device which utilizes gas discharge illumination.

2. Background Description

A simple and inexpensive nanoscale illumination device has not been previously described outside of light emitting diode (LED) technology. LED's typically are restricted by their range of color and the need for electrodes.

U.S. Pat. No. 3,919,577 to Hoehn et al. discloses a gaseous discharge display panel having a pair of films separated by a thin volume containing a gaseous discharge medium. Light is produced during discharge and terminates upon the build up of electrons on the opposed pairs of elemental areas. A tubular region allows exhausting the space between dielectric layers and filing the space with ionizable gas.

U.S. Pat. No. 5,469,021 to Lepselter discloses a gas discharge flat-panel display which employs a set of criss-crossed conductors with a gas contained in the space between the conductors at each crosspoint. Light emissive discharge occurs at a selected crosspoint when a voltage is applied to the pair of crossed conductors for the selected crosspoint.

U.S. Pat. No. 3,602,754 to Pfaender discloses a gas discharge display assembled from a plurality of capillary sized gas tubes. A criss-crossed network of electrodes is formed on either side of the layer of capillary sized gas tubes for selective creation of illuminating discharges.

U.S. Pat. No. 4,926,095 to Shinoda discloses a three component gas mixture of neon, argon, and xenon for a fluorescent gas-discharge color display panel. In operation, a fluorescent material is excited by a gas-discharge formed from the gas mixture which is positioned within a channel volume in the display. Excitation of the gases results from selective activation of crisscrossed electrodes.

All of the above described gas-discharge devices employ large volumes of trapped gas, and an elaborate network of criss-crossed conductors for selective activation or discharge of the gas. What is needed is a less expensive design and process for forming gas discharge illumination devices

SUMMARY OF THE INVENTION

It is an object of this invention to provide a low cost, gas discharge illumination device which is operable in both an electrodeless and electroded form, and which allows for the display of a range of colors.

According to the invention, a matrix is fabricated to contain a plurality of sealed cavities with an ionizable gas therein. The matrix can be fabricated by a variety of techniques including selectively forming vias in the material and overcoating the vias with a sealant in an ionizable gas ambient, bubbling ionizable gas through the matrix material while it is in viscous form, or by other means. The matrix material, or selected portions thereof, is subjected to an electric field which causes ionization of the entrapped gases and concomitant illumination. By incorporating several different gases into the matrix material, the display can provide a range of different colors. Control of color illumination can be achieved using gases of different activation potentials. The gas discharge illumination device can take either an electrodeless or electroded form. All that is required is to position the matrix material within the electric field of an electric field generators (i.e., electric coil, electrodes of a capacitor, etc.). The devices can be arrayed in a matrix for imaging purposes, such as in pixels used in display technology, or they may be used as a passive device, such as an electric field detector.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
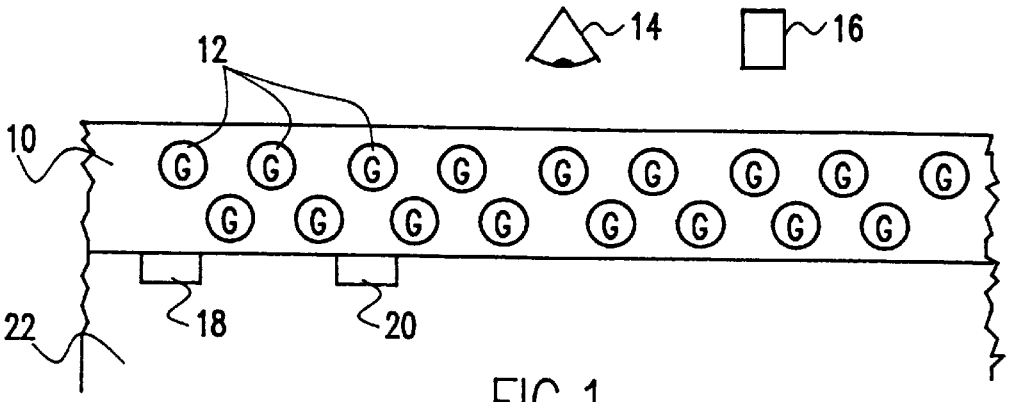
FIG. 1 is a cross-sectional side view of a gas discharge illumination device according to the present invention.

FIG. 1 shows a matrix material 10 with a plurality of gas filled sealed cavities 12. Subjecting the ionizable gas to a high frequency electric field of sufficient strength ionizes the gas within the sealed cavities 12 and produces light. The matrix material 10 will preferably be transparent or partially transparent to allow illuminating light emanating from the sealed cavities 12 to be viewed by an eye or sensor 14 depending on the application. Light from the sealed cavities 12 may also be optically coupled to a light carrying or light activated device 16, such as an optical fiber or photomultiplier tube, respectively. Typical examples of a matrix material 10 include glasses such as silicates, aluminates and carbonates, and polymers such as polyimides, organosiloxanes, hydrogen silsesquioxanes (e.g., Dow Corning's "Fox" SOG), and acrylics, and will depend upon the application as well as the method used for fabricating the gas illumination discharge device of this invention.

The ionizable gas inside the sealed cavities 12 of the matrix material 10 can be any gas, including air, methane, etc., which can be ionized upon being subjected a high frequency electric field of suitable strength, and which will produce light upon ionization. It is expected that the noble gases, such as neon, argon, krypton, and xenon will be preferred for use in this invention; however, other gases which produce fluorescence, phosphorescence, and chemiluminescence may also be used. The ionizable gases can be used alone or in combination in the sealed cavities 12 of the matrix material. In addition, as will be explained in connection with FIGS. 2*a–f*, different ionizable gases can be positioned within different subsets of sealed cavities 12. Using several different ionizable gases within the sealed cavities 12 of the matrix material 10, each of which produces a different color, allows for the production of a multi-colored gas discharge illumination device.

In multicolored applications, it may be desirable to select ionizable gases that are activatable at different electric field strengths (i.e., the gases have different ionization potentials). Thus, by controlling the field strength to which the matrix material is selected, the light emanating from the gas discharge illumination panel can selectively be blue, red, yellow, or different colors or combinations of these colors. However, in some applications, it may be desirable to have a single activating field cause ionization of all of the different gases within the sealed cavities 12 of the matrix material 10 at the same time to produce a multicolored display.

In the electroded version of this invention, the gases within the sealed cavities 12 are selectively ionized using an intentionally applied electric potential, such as is employed in "neon" signs. The left half of FIG. 1 shows electrodes 18 and 20 embedded in substrate 22 which can be used to generate an ionizing potential for the gases positioned in the sealed cavities 12 directly above the electrodes 18 and 20. The electrodes 18 and 20 can be metal lines of a comb capacitor positioned on a dielectric substrate 22 such as aluminum oxide, silicon dioxide, etc., or the electrodes 18 and 20 may take the form of electric field producing elements (i.e., tungsten, copper, aluminum, titanium, etc.) created in a silicon substrate 22. All that is required for the electroded version of this invention is that the matrix material 10 be positioned on or near a substrate 22 having elements 18 and 20 for producing an electric field (preferably high frequency (i.e., >1 kHz), but can also be as low (i.e., 60 Hz, such as used in fluorescent lighting)) of sufficient strength to ionize gases within the sealed cavities 12 at specific locations.

Figure 3:
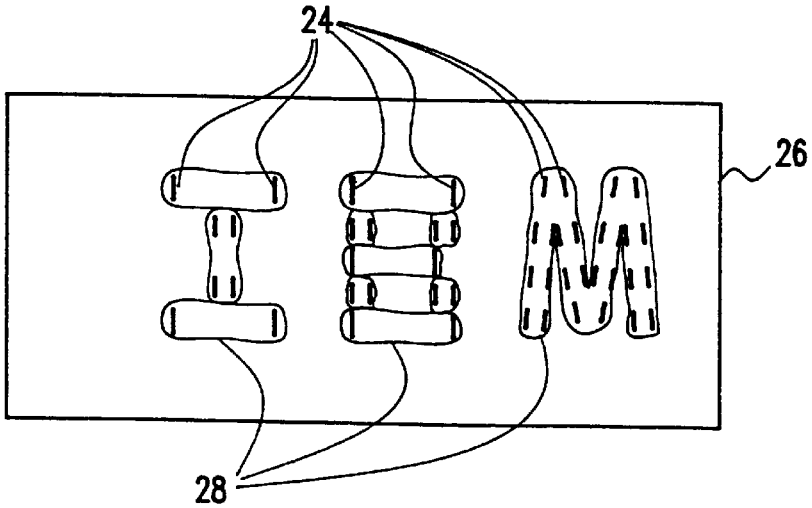
FIG. 3 is a top view showing a matrix layout for the gas discharge illumination device of this invention.

FIG. 3 shows an electroded version of this invention wherein a plurality of electrodes 24 is positioned underneath matrix material 26 in an array which form the letters "I", "B", and "M". Upon activation of the electrodes 24, which can be done under computer control or using other circuitry, the gases in the sealed cavities in the matrix material 26 become ionized and produce lighted regions 28 which form the letters.

In the electrodeless version of this invention, such as in the right half of FIG. 1 where no electrodes are positioned under the matrix material 10, the gases in the sealed cavities are ionized whenever the gas discharge illumination device is subjected to a high frequency electric field of suitable strength. In this embodiment, the device may be used as a field strength sensor device. As discussed above, if several different ionizable gases are contained within different sealed cavities 12 and each of which has a different ionizing potential, the electric field to which the electrodeless sensor is subjected can be precisely determined by identifying which color is illuminated, the color being associated with a specific gas of a specific ionizing potential. Alternatively, if a single gas is utilized in the sealed cavities 12, the sensor can function as a threshold device wherein illumination results only when a field of sufficient strength is detected.

The gas discharge illumination devices of this invention are useful in a variety of applications including backlighting plates for displays such as LCD screens used in personal computing devices, pages, phones, etc.; stand alone low level lighting sources for gauges, auto dashboards, and instrument panels where bright lighting is not needed or wanted; and as single or multi-colored display elements where electrodes or other electric field generators are configured in a matrix. Since the cavities may be filled with any number of ionizable gases, the range of colors is not limited, and arrays of such devices could be used to form illuminated images and couple electronic devices to optical devices such as in photo/electric switches, fiber optics, and other electro optical hybrid technologies. The devices used for electric field generation can be wide ranging and include electrodes of a capacitor, batteries, radio frequency sources, high frequency A/C source (i.e., Tesla coil), etc. For exemplary purposes, neon gas in a sealed cavity in a glass matrix material can be activated to provide illumination by application of a DC discharge (typically, but not restricted to the conditions of 100–400 Volts, 100–300 $\mu$A current). Additionally, application of an A/C discharge (typically, but not limited to the conditions of 60 Hz to >1 kHz, 100–500 W applied power) will also result in illumination. U.S. Pat. No. 5,559,403 provides information on DC glow discharge conditions and is herein incorporated by reference. In the passive mode, the ionizable gases will emit light of a characteristic color when subjected to an external high frequency field. The sensitivity of the device may be tailored to several levels by using a plurality of ionizable gases with a range of ionization potentials. Sensitivity and utility of such a device may be enhanced through coupling with another device such as a photomultiplier tube.

The gas discharge illumination device of FIG. 1 can be fabricated by a number of different techniques.

In one simple technique, the desired ionizable gas or gas mixture is "bubbled" through a molten glass or viscous matrix material, such as spin on glass, polyimide nanofoams, monomers and other polymer precursors, etc., so as to provide a viscous film with entrapped bubbles containing the desired ionizable gases. The viscous film is then applied to a substrate and allowed to set or otherwise solidify with bubbles of the desired ionizable gas being encapsulated within the matrix material. This methodology has the advantage that it is capable of providing a coating on irregular surfaces, such that these irregular surfaces will include a light emitting film. Preferably, the "bubbles" or sealed volumes within the matrix material will be less than a micron in diameter, and more preferably on the nanometer scale. The "bubble" size in the film produced is a function of the flow rate of gas into the molten or viscous matrix material, and the characteristics of matrix material itself including its viscosity and set rate. Creation of films having sealed nanopores filled with ionizable gas can be accomplished by a number of methodologies well known to those of skill in the art. Typical examples for incorporating gas into polymers and glasses are described in *Proceedings of Low Dielectric Constant Material and Interconnects Worshop* (*SEMATECH. 4/40–May* 7, 1996) or U.S. Pat. No. 5,508,234 which is herein incorporated by reference.

Figure 2A:
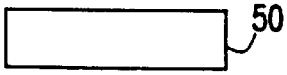
FIGS. 2*a–f* are sequential cross-sectional side views showing one method of fabricating a multi-colored gas discharge illumination device according to the present invention.
Figure 2B:
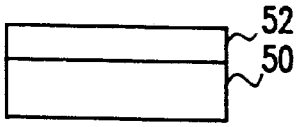
Figure 2C:
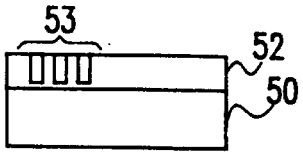
Figure 2D:
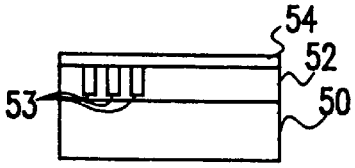

FIGS. 2*a–f* show a fabrication method which is particularly useful for producing multi-colored gas discharge illumination displays. In FIGS. 2*a–b*, a suitable substrate 50, such as silicon or silicon dioxide which can include electric field generating devices arranged in an array therein, is overcoated with a matrix material 52, such as glass, polymer, etc. In FIG. 3, a pattern of holes or vias 53 is formed in the matrix material 52. The holes 53 can take the form of an array or matrix, such as individual pixels in a display. The holes 53 can be created using conventional lithography and etching techniques, or by using laser ablation or other methodologies. Wet and dry isotropic etching, in conjunction with lithographic photoresist patterning are preferred and can be used to create vias 54 of controlled, submicron or nanoscale dimensions aligned directly below each opening in a photoresist layer (not shown). FIG. 2*d* shows overcoating the matrix material 52 with a capping material 54 to transform the vias 53 into sealed cavities. The overcoating step is performed in an ambient of the ionizable gas or gases of interest, such that these gases become trapped within the vias after application of the capping material 54. The capping material 54 can be applied as a spin-on-glass or by other suitable techniques.

An entire device could be patterned according to the procedure steps shown in FIGS. 2*a*–2*d*. If desired, electrodes can be patterned onto the surface of the capping material 54.

Figure 2E:
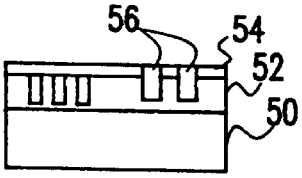
Figure 2F:
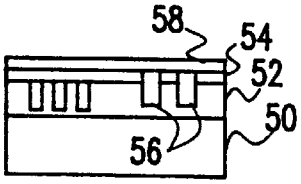

With reference to FIGS. 2*e*–*f*, it can be seen that a second region, and by implication, several other regions, can be patterned in subsequent steps. In FIG. 2*e* vias 56 are formed in a second region by lithography and etching, or other suitable techniques, as described above. FIG. 2*f*, shows that vias 54 are then overcoated with another capping material 58 to transform the vias 56 into sealed cavities. Preferably, the capping material 58 is applied while in an ambient of a second ionizable gas different from that contained in sealed cavities 53 such that a different colored light will emanate from sealed cavities 56 than from sealed cavities 53. The amount of different ionizable gases and different colors which can be produced is limited only by the amount of space in the matrix material 52 in which vias can be formed. Because the vias are preferably submicron in size, a wide range of different colors can be accommodated and a wide variety of different display arrangements can be achieved.

While the invention has been described in terms of its preferred embodiments, those of skill in the art will recognize that the invention can be practiced with modification within the scope of the appended claims.

We claim:

1. A gas discharge illumination device, comprising:

a matrix material including a plurality of sealed cavities distributed within said matrix material, said sealed cavities being submicron in size;

an ionizable gas positioned within said sealed cavities; and an electric field generator for generating an electric field of sufficient strength to ionize said ionizable gas.

2. The device of claim 1 wherein said ionizable gas is a noble gas.

3. The device of claim 2 wherein said noble gas is selected from the group consisting of neon, argon, krypton, and xenon.

4. The device of claim 1 wherein said sealed cavities are on the order of a nanometer in size.

5. The device of claim 1 wherein the matrix material is selected from the group consisting of silicon dioxide, aluminum oxide, silicon nitride, polymers, and insulators.

6. The device of claim 1 wherein the electric field generator is an electrode positioned adjacent said matrix material.

7. The device of claim 1 wherein the electric field generator is a semiconductor device positioned adjacent said matrix material.

8. The device of claim 1 wherein the electric field generator is separate from said matrix material, but produces an electric field which extends to said matrix material.

9. The device of claim 1 further comprising an actuator for selectively activating said electric field generator.

10. A gas discharge illumination device, comprising:

a matrix material including a plurality of sealed cavities distributed within said matrix material, said sealed cavities being submicron in size;

first and second ionizable gases different from each other positioned within first and second sealed cavities of said plurality of sealed cavities; and an electric field generator for generating an electric field of sufficient strength to ionize at least one of said first and second ionizable gases.

11. The device of claim 10 wherein said electric field generator can generate an electric field of sufficient strength to ionize both of said first and second ionizable gases.

12. The device of claim 10 further comprising a second electric field generator for generating a second electric field of sufficient strength to ionize at least a second of said first and second ionizable gases.

13. The device of claim 10 wherein said first and second ionizable gases produce first and second different colors upon ionization.

14. The device of claim 10 wherein said first and second ionizable gases are noble gases.

15. The device of claim 10 further comprising a third ionizable gas different from said first and second ionizable gases positioned within third sealed cavities of said plurality of cavities.

16. The device of claim 10 further comprising a plurality of ionizable gases different from said first and second ionizable gases positioned in a sub-plurality of said plurality of sealed cavities.

17. A method for producing a gas discharge illumination device comprising the steps of:

capturing an ionizable gas within a plurality of sealed cavities formed in a matrix material wherein said sealed cavities are submicron in size;

orienting said matrix material within an electric field region of an electric field generator.

18. The method of claim 17 wherein said step of capturing includes the steps of:

forming a plurality of openings in said matrix material; and overcoating said openings with a sealing material in an ambient environment containing said ionizable gas.

19. The method of claim 17 wherein said step of capturing includes the steps of:

forming a plurality of openings in said matrix material;

overcoating a first subset of said plurality of openings with a sealing material in an ambient environment containing a first ionizable gas; and overcoating a second subset of said plurality of openings with said sealing material in an ambient environment containing a second ionizable gas different from said first ionizable gas.

20. The method of claim 17 wherein said step of orienting is performed by forming said matrix material on a semiconductor substrate.

21. The method of claim 17 wherein said step of capturing includes the steps of bubbling said ionizable gas through said matrix material while said matrix material is in viscous form, and solidifying said matrix material.

22. The method of claim 17 wherein said step of capturing includes the step of mixing said matrix material together with a solid precursor of said ionizable gas while said matrix material is in a viscous form, solidifying said matrix material, and converting said solid precursor to said ionizable gas after solidification of said matrix material.

23. A method of illumination, comprising the step of exposing a matrix material including a plurality of submicron sized sealed cavities distributed within said matrix material each of which contains an ionizable gas positioned therein to an electric field of sufficient strength to ionize said ionizable gas.

24. The method of illumination of claim 23 wherein said step of exposing is performed selectively.

* * * * *